US011376579B2

(12) United States Patent
Inoue

(10) Patent No.: US 11,376,579 B2
(45) Date of Patent: Jul. 5, 2022

(54) PIPETTE DEVICE

(71) Applicant: MUROOKA INDUSTRY CO., LTD., Tochigi (JP)

(72) Inventor: Kohsen Inoue, Tochigi (JP)

(73) Assignee: MUROOKA INDUSTRY CO., LTD., Tochigi (JP)

( * ) Notice: Subject to any disclaimer, the term of this patent is extended or adjusted under 35 U.S.C. 154(b) by 278 days.

(21) Appl. No.: 16/334,745

(22) PCT Filed: Sep. 20, 2016

(86) PCT No.: PCT/JP2016/077716
§ 371 (c)(1),
(2) Date: May 28, 2019

(87) PCT Pub. No.: WO2018/055675
PCT Pub. Date: Mar. 29, 2018

(65) Prior Publication Data

US 2019/0388885 A1 Dec. 26, 2019

(51) Int. Cl.
*B01L 3/02* (2006.01)

(52) U.S. Cl.
CPC ..... *B01L 3/021* (2013.01); *B01L 2200/0684* (2013.01); *B01L 2300/0832* (2013.01); *B01L 2300/123* (2013.01); *B01L 2400/0478* (2013.01)

(58) Field of Classification Search
None
See application file for complete search history.

(56) References Cited

U.S. PATENT DOCUMENTS

| | | | | |
|---|---|---|---|---|
| 3,525,264 | A * | 8/1970 | Cybulsky | A61M 5/344 73/864.14 |
| 4,593,837 | A * | 6/1986 | Jakubowicz | B01L 3/0275 222/144.5 |
| 5,364,596 | A * | 11/1994 | Magnussen, Jr. | B01L 3/0224 422/515 |
| 2006/0018799 | A1* | 1/2006 | Wong | A61B 10/02 422/400 |
| 2016/0199830 | A1* | 7/2016 | LaCroix | B01L 3/0217 73/864.13 |

FOREIGN PATENT DOCUMENTS

| | | |
|---|---|---|
| JP | S61212336 | 9/1986 |
| JP | H02164457 | 6/1990 |
| JP | H06210187 | 8/1994 |
| JP | 2009013704 | 1/2009 |
| JP | 4989133 | 8/2012 |
| JP | 5657861 | 1/2015 |

OTHER PUBLICATIONS

"International Search Report (Form PCT/ISA/210) of PCT/JP2016/077716", dated Nov. 29, 2016, with English translation thereof, pp. 1-4.

* cited by examiner

*Primary Examiner* — Matthew D Krcha
*Assistant Examiner* — Brittany I Fisher
(74) *Attorney, Agent, or Firm* — JCIP Global Inc.

(57) ABSTRACT

A pipette device is provided and prevents the corrosion of main metal parts without causing a significant rise in costs. A pipette device includes a piston portion that is movable in order to suck a liquid and an air hole for discharging an air generated from the liquid sucked by the piston portion to an outside. The air is discharged from the air hole in response to movement of the piston portion.

4 Claims, 10 Drawing Sheets

PIPETTE DEVICE

CROSS-REFERENCE TO RELATED APPLICATION

This application is a 371 application of the international PCT application serial no. PCT/JP2016/077716, filed on Sep. 20, 2016. The entirety of the above-mentioned patent application is hereby incorporated by reference herein and made a part of this specification.

TECHNICAL FIELD

The present invention relates to a pipette device that can suck and hold a liquid and can discharge the liquid in response to motion of a piston portion.

BACKGROUND ART

As such a pipette device, a micropipette device that includes removing means for removing and discarding a pipette tip disposed at a tip of the pipette device after use is disclosed in Japanese Patent No. 4989133 which belongs to the present applicant. In addition, a micropipette device is disclosed in Japanese Patent No. 5657861. The micropipette device is a pipette device including a knurled rotating ring that is fitted into a shaft portion common to a rotary digital meter and is for setting and regulating a suction collection amount of a liquid to be collected. A notch of the knurled rotating ring is lightly engaged with at least one protruding inner corner portion of a window edge portion of a pipette housing, and functions, with the protruding inner corner portion, as a mild stopper that can be released by finger movement instead of being naturally released.

As described above, the present applicant manufactures a pipette device having various functions. The pipette device is used in order to suck and collect various liquid chemical substances in the fields of medicine and science. Therefore, the pipette device corrodes in some cases depending on a liquid chemical to be used.

That is, as will be described later, the pipette device sucks a liquid into a pipette tip which is removably disposed at a tip thereof in response to movement of a piston portion. A packing portion that has an annular shape, that is, a ring shape and has a hole-shaped annular inner portion in a middle part thereof is disposed on a piston cylinder portion of the piston portion. A liquid is sucked by the piston portion sliding in the annular inner portion of the packing portion. As described above, the liquid is acidic or alkaline, and has a possibility of corroding a metal part. Since the piston portion is disposed such that watertightness is maintained by the packing portion, a possibility that the acidic or alkaline air easily enters a case portion in which the piston rod portion is disposed is relatively low. Therefore, air containing components of a chemical to be used is blocked by the piston portion and the packing portion, and thus a possibility that the air infiltrates into a case thereof is low in a short period of time.

However, probability that the air contains components of a sucked chemical solution, and the components corrode a metal part of the pipette device is high. Thus, there is a possibility that the air enters the case portion from a gap between the packing portion and the piston portion in long-term use.

Although the parts disposed in the case are relatively unlikely to corrode since the parts are mainly manufactured of a synthetic resin and stainless steel, the corrosion of the stainless steel progresses under certain conditions in some cases. In a stage when corrosion is found in particular under long-term use, the pipette device loses a function thereof in some cases.

When the prior art is examined to solve such a problem, no invention focusing on the problem is found. For example, using stainless steel as a material in order to resist corrosion is proposed in Japanese Patent No. 5511375. As described above, the proposal with respect to corrosion is changing the material to a material that is unlikely to corrode. However, as described above, all main metal parts are made of stainless steel in the pipette device sold by the present applicant. Therefore, a rise in manufacturing costs cannot be prevented by using a material that can resist corrosion or further carrying out surface treatment such as plating on the metal parts.

CITATION LIST

Patent Literature

Patent Literature 1: Japanese Patent No. 4989133
Patent Literature 2: Japanese Patent No. 5657861
Patent Literature 3: Japanese Unexamined Patent Application Publication No. 2009-013704

SUMMARY

Technical Problem

The present invention is devised in view of this point, and an object thereof is to provide a pipette device that prevents the corrosion of main metal parts without causing a significant rise in costs.

Solutions to Problem

According to a first aspect, in order to solve the problem as a result of thorough research and development, there is provided a pipette device including a piston portion that is movable in order to suck a liquid and an air hole for discharging an air generated from the liquid sucked by the piston portion to an outside. The air is discharged from the air hole in response to movement of the piston portion.

According to a second aspect, there is provided a pipette device including a pressing portion that is disposed on a rear end portion for a user to press, a piston rod portion that is connected to the pressing portion, a piston portion that is connected to the piston rod portion and is movable in order to suck a liquid, and a case portion in which the piston rod portion is disposed and which has an air hole for discharging an air generated from the liquid sucked by the piston portion to an outside. The air is discharged from the air hole of the case portion in response to movement of the piston portion.

According to a third aspect, there is provided a pipette device including a pressing portion that is disposed on a rear end portion for a user to press, a piston rod portion that is connected to the pressing portion, a piston portion that is connected to the piston rod portion and is movable in order to suck a liquid, and a piston accommodating portion in which the piston portion is movably disposed and which has an air hole for discharging an air generated from the liquid sucked by the piston portion to an outside. The air is discharged from the air hole of the piston accommodating portion in response to movement of the piston portion.

According to a fourth aspect, the pipette device of the second aspect further includes: a piston accommodating portion for movably disposing the piston portion. The piston accommodating portion has: a piston accommodating upper portion configuring the piston accommodating portion, a piston accommodating lower portion configuring the piston accommodating portion, and a packing portion that has an annular shape between the piston accommodating upper portion and the piston accommodating lower portion and has an annular inner portion. The piston portion is disposed to be slidable in the annular inner portion of the packing portion that has the annular shape.

According to a fifth aspect, in the pipette device of the third aspect, the piston accommodating portion has: a piston accommodating upper portion, a piston accommodating lower portion, and a packing portion that has an annular shape between the piston accommodating upper portion and the piston accommodating lower portion. The piston portion is disposed to be slidable in an annular inner portion of the packing portion. The air hole is disposed in the piston accommodating upper portion.

According to a sixth aspect, the pipette device of the third aspect to the fifth aspect further includes: a pipette tip holding portion that is disposed in a front end portion direction of the piston accommodating portion and removably holds a pipette tip.

According to a seventh aspect, the pipette device of the second aspect to the sixth aspect further includes: an elastic portion that biases the piston rod portion in a rear end portion direction.

Effect of the Invention

Since air having components of a chemical can be discharged from the air hole to the outside as the present invention is configured and acts as described above, the pipette device that prevents the corrosion of the main metal parts without causing a significant rise in costs can be provided.

DESCRIPTION OF EMBODIMENTS

Figure 1:
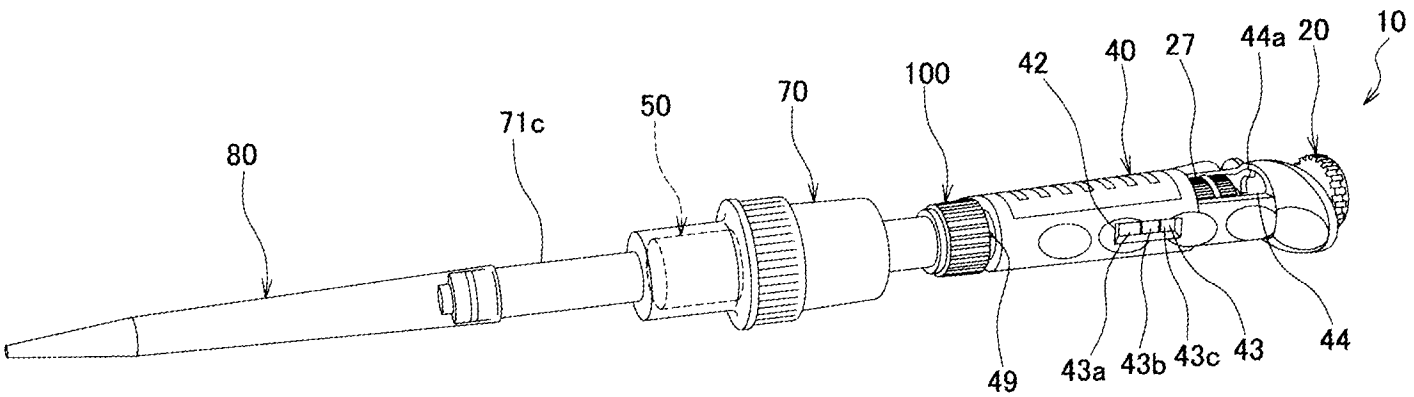
FIG. 1 is a perspective view of a pipette device.

A pipette device 10 of the embodiment will be described. The pipette device 10 of a first embodiment has a pressing portion 20 that is disposed on a rear end portion for a user to press, a piston rod portion 30 connected to the pressing portion 20, a case portion 40 for the user to grab, a piston portion 50 that is connected to the piston rod portion 30 and is movable in order to suck a liquid, a piston accommodating portion 70 that accommodates the piston portion 50. The case portion 40 has an air hole 49 for discharging air X generated from the liquid sucked by the piston portion 50 to the outside (refer to FIGS. 1 and 2).

That is, the pipette device 10 is a device in which the air hole 49 is provided in the case portion 40 for a user to grab in order to discharge the air X, which is sucked by the piston portion 50 and is generated from a liquid chemical, to the outside. Therefore, the piston portion 50 is movable in a front end portion direction F and a rear end portion direction R of the pipette device 10. In response to motion of the piston portion moving, the air X in the pipette device 10 can be discharged to the outside from the air hole 49, or fresh air can be introduced from the air hole 49. Consequently, corrosion can be prevented without making a metal part in the pipette device 10 of a material which is highly resistant to corrosion or performing surface treatment such as plating.

Each configuration of the pipette device 10 will be described. The pipette device 10 has the pressing portion 20, the piston rod portion 30 connected to the pressing portion 20, the case portion 40 that accommodates a part of the piston rod portion 30 and has the air hole 49 allowing outside air to pass therethrough, the piston portion 50, a packing portion 60, and the piston accommodating portion 70. In addition, a pipette tip 80 is removably disposed. A center of each of the pressing portion 20, the piston rod portion 30, the case portion 40, the packing portion 60, the piston accommodating portion 70, and the piston portion 50 is disposed on the same line.

The pressing portion 20 is literally for a user to perform an operation of pressing in order to discharge a liquid as will be described later. The pressing portion 20 has a long shaft portion 21, a disk-shaped knob portion 22 in a rear end direction R, and an uneven portion 23 having a recessed portion and a projecting portion that are disposed on an edge of the knob portion 22. As will be described later, the uneven portion 23 is provided as a slip stopper when a user rotates the shaft portion 21 about an axis. In addition, the pressing portion has a long hollow tubular portion 26, and the long shaft portion 21 is disposed inside the tubular portion 26. The shaft portion 21 is fixed such that the rotation of the shaft portion about the axis synchronizes with the rotation of the tubular portion 26 although not illustrated. When the shaft portion 21 rotates one time about the axis, also the tubular portion 26 rotates one time about the shaft portion 21.

The tubular portion 26 rotates about the axis as described above. Since a female thread portion 41*a* is formed inside a first case portion 41 of the case portion 40, which is to be described later, and also a male thread portion 26*a* is formed in the tubular portion 26, the female thread portion and the male thread portion are screwed with each other in the tubular portion 26. That is, the male thread portion 26*a* is screwed with the female thread portion 41*a*. Therefore, when the shaft portion 21 rotates about the axis, also the tubular portion 26 rotates, and the shaft portion 21 relatively moves with respect to the tubular portion 26 in the front end portion direction F. When the shaft portion 21 rotates reversely, the shaft portion 21 relatively moves with respect to the tubular portion 26 in the rear end portion direction R. Accordingly, as will be described later, the piston portion 50 is moved forward in the front end portion direction F or is moved backward in the rear end portion direction R by the piston rod portion 30 connected to the shaft portion 21, and thus the piston portion can adjust an increase or decrease in the amount of a liquid to be sucked. This will be further described later.

Figure 3:
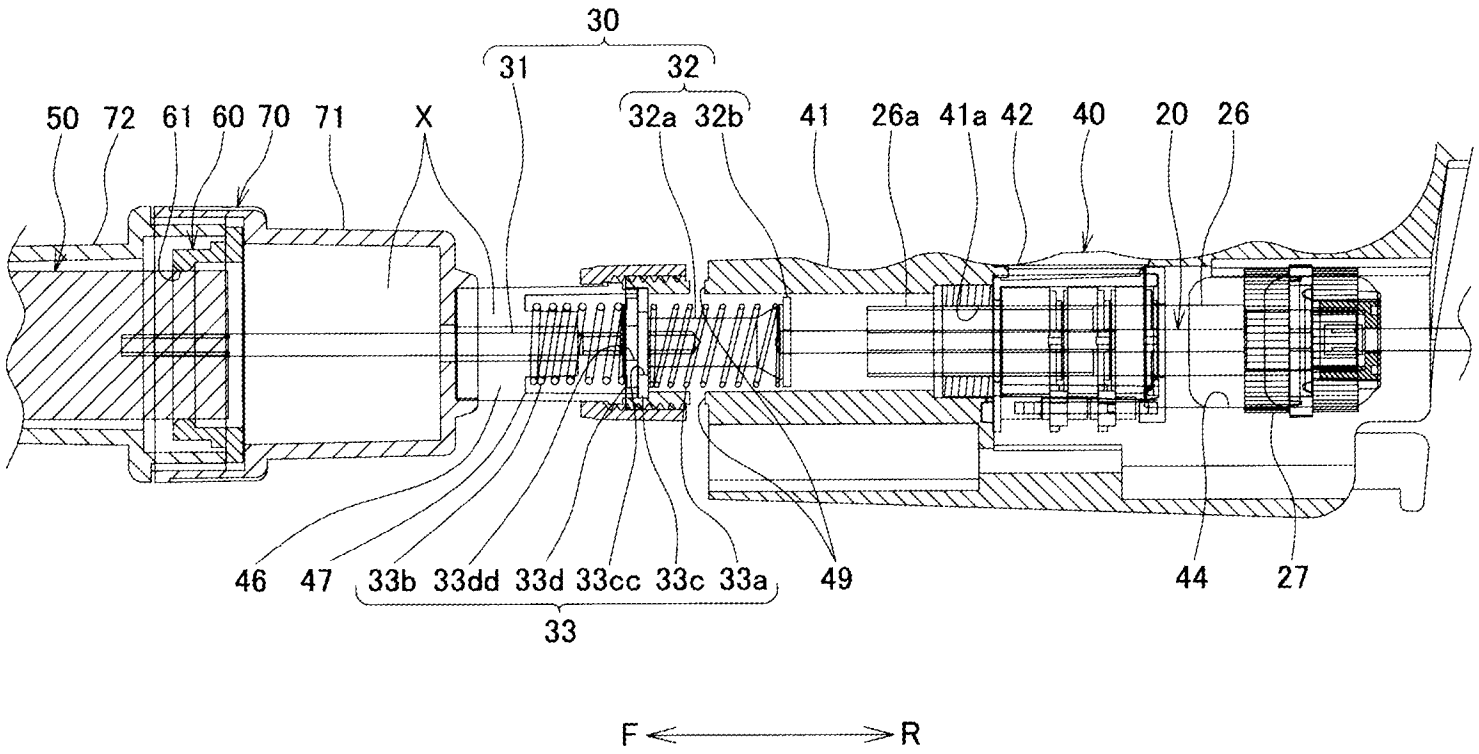
FIG. 3 is a longitudinal section enlarged view of a case portion of the pipette device.

The piston rod portion 30 is disposed inside the case portion 40. In addition, the piston rod portion 30 has a piston shaft portion 31 and a thick shaft upper end portion 32. The thick shaft upper end portion 32 has a thick shaft portion 32*a* and an upper end portion 32*b*. In addition, the piston shaft portion 31 literally has a long rod shape, and is disposed such that one end of the piston shaft portion 31 is covered by the thick shaft portion 32*a* which is thicker than the piston shaft portion 31. That is, the thick shaft portion 32*a* has a hollow tubular shape, and the piston shaft portion 31 is disposed and fixed therein. In addition, the dish-shaped upper end portion 32*b* is fixed to an end portion of the thick shaft portion 32*a*. The other end of the piston shaft portion 31 in the front end portion direction F is connected to the piston portion 50 to be described later (refer to FIG. 3).

An elastic portion 33 biases the piston rod portion 30 in a direction of the pressing portion 20, that is, the rear end portion direction R. In the elastic portion 33, a first spring portion 33*a*, a first washer portion 33*c*, a second washer portion 33*d*, and a second spring portion 33*b* are disposed in this order from the rear end portion direction R to an end portion direction F. The piston shaft portion 31 is inserted in all of the first spring portion, the first washer portion, the second washer portion, and the second spring portion. The piston shaft portion 31 is disposed to penetrate through a center of each of the first spring portion 33*a*, the first washer portion 33*c*, the second washer portion 33*d*, and the second spring portion 33*b*. Therefore, in this case, it is preferable that the first spring portion 33*a* and the second spring portion 33*b* be coil springs. In addition, it is preferable that the first washer portion 33*c* and a second washer portion 33 each have a disk shape (refer to FIG. 3).

The first spring portion 33*a* has one end that is in contact with the thick shaft upper end portion 32 of the piston rod portion 30, and the other end portion that is in contact with the first washer portion 33*c*. In addition, the first washer portion 33*c* and the second washer portion 33*d* are disposed to be in contact with each other (refer to FIG. 3).

In addition, the second spring portion 33*b* has one end that is in contact with the second washer portion 33*d*, and the other end that is in contact with a recessed portion 47 of a second case portion 46 to be described later. A center hole portion 33*cc*, which is a circular hole, is disposed in the center of the first washer portion 33*c*, and the center hole portion 33*cc* has a diameter that allows the thick shaft portion 32*a* to pass therethrough. A second center hole portion 33*dd*, which is a circular hole, is disposed in the center of second washer portion 33*d*, and the second center hole portion 33*dd* has a diameter that is smaller than the center hole portion 33*cc* so as not to allow the thick shaft portion 32*a* to pass therethrough. Therefore, the diameter of the center hole portion 33*cc*, a diameter of the pressing portion 20, and the diameter of the second center hole portion 33*dd* are set in diameter decreasing order. As described above, the piston shaft portion 31 of the piston rod portion 30 penetrates through all of the first spring portion, the first washer portion, the second washer portion, and the second spring portion. In addition, the second spring portion 33*b* has a spring constant higher than the first spring portion 33*a*.

In addition, as described above, the piston shaft portion 31 is disposed to be inserted in all, that is, the first spring portion 33*a*, the first washer portion 33*c*, the second washer portion 33*d*, and the second spring portion 33*b*. Consequently, the piston rod portion 30 is biased in the rear end portion direction R by the first spring portion 33*a*, the first washer portion 33*c*, the second washer portion 33*d*, and the second spring portion 33*b*, and this serves as resistance when pressing the pressing portion 20 in the front end portion direction F. For this reason, also the piston portion 50 to be described later is biased in the rear end portion direction R.

As described above, the case portion 40 has the first case portion 41 and the second case portion 46. The first case portion 41 has a hollow tubular inside, and an external shape thereof is almost a wedge shape allowing a user to grab. Therefore, the case portion 40 has a shape that allows the user to easily grasp.

In addition, the first case portion 41 has a window portion 42 and a second window portion 44. A graduation portion 43 is disposed inside the window portion 42. The graduation portion 43 displays a three-digit number, and displays a movement amount of the tubular portion 26. The graduation portion 43 is configured of a transparent resin and has a hollow tubular shape. Inside the graduation portion, three stages of numbers are displayed. A lower stage 43*a* displays the tens' place, an interruption 43*b* displays the hundreds' place, and an upper stage 43*c* displays the thousands' place. One graduation of the lower stage 43*a* indicates 10, and a graduation indicating 50 is marked with one rotation. When the lower stage 43*a* rotates by ten graduations, a middle stage 43*b* rotates by one graduation. When the middle stage 43*b* rotates one time, the upper stage 43*c* rotates by one graduation. While graduations are marked from 0 to 9 in the upper stage 43*c*, the upper stage 43*c* is allowed to rotate up until a graduation of 6. This will be described later.

Figure 4C:
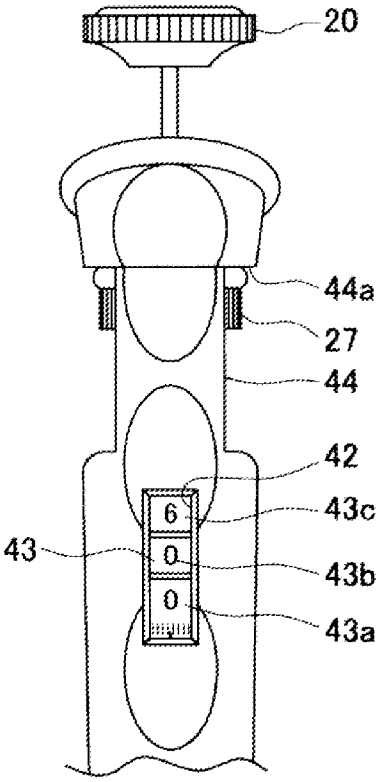
FIG. 4*c* is a view illustrating a state where the second knob portion is disposed on an upper side of the second window portion.
Figure 4B:
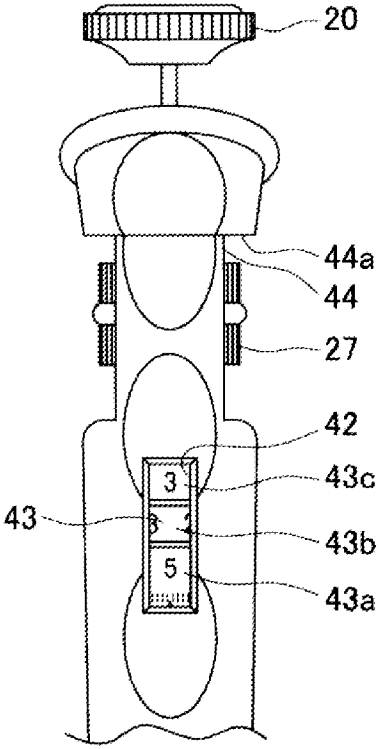
FIG. 4*b* is a view illustrating a state where the second knob portion is disposed in a middle of the second window portion.
Figure 4A:
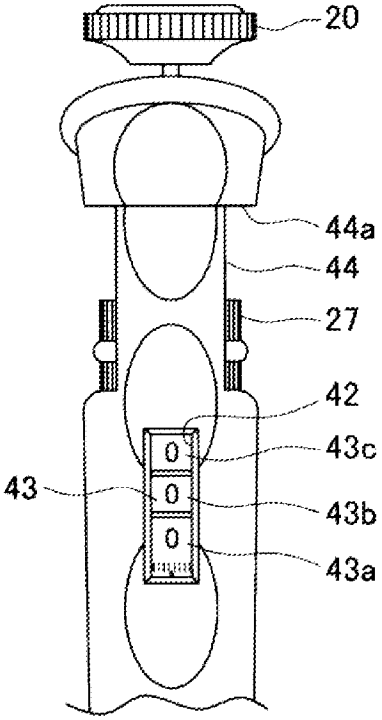
FIG. 4*a* is a view illustrating a state where a second knob portion is disposed on a lower side of a second window portion.

A second knob portion 27 fixed to the tubular portion 26 is disposed on the second window portion 44. A user can increase or decrease the movement amount of the tubular portion 26 by rotating the second knob portion 27 about an axis through the second window portion 44 as in the case of rotating a knob portion 23. By the second knob portion 27 disposed on the tubular portion 26 coming into contact with a second window upper end portion 44*a* of the second window portion 44, the movement of the tubular portion 26 is limited, and the second knob portion 27 is set not to rotate any further. Therefore, as described above, the movement amount of the tubular portion 26 is limited such that 6 is the maximum of the tens' place (refer to FIGS. 4*a*, 4*b*, and 4*c*). Therefore, the movement of the pressing portion 20 which is fixed thereto is limited, and thereby the movement of the piston rod portion 30 connected to the pressing portion and the movement of the piston portion 50 are also limited.

Figure 5:
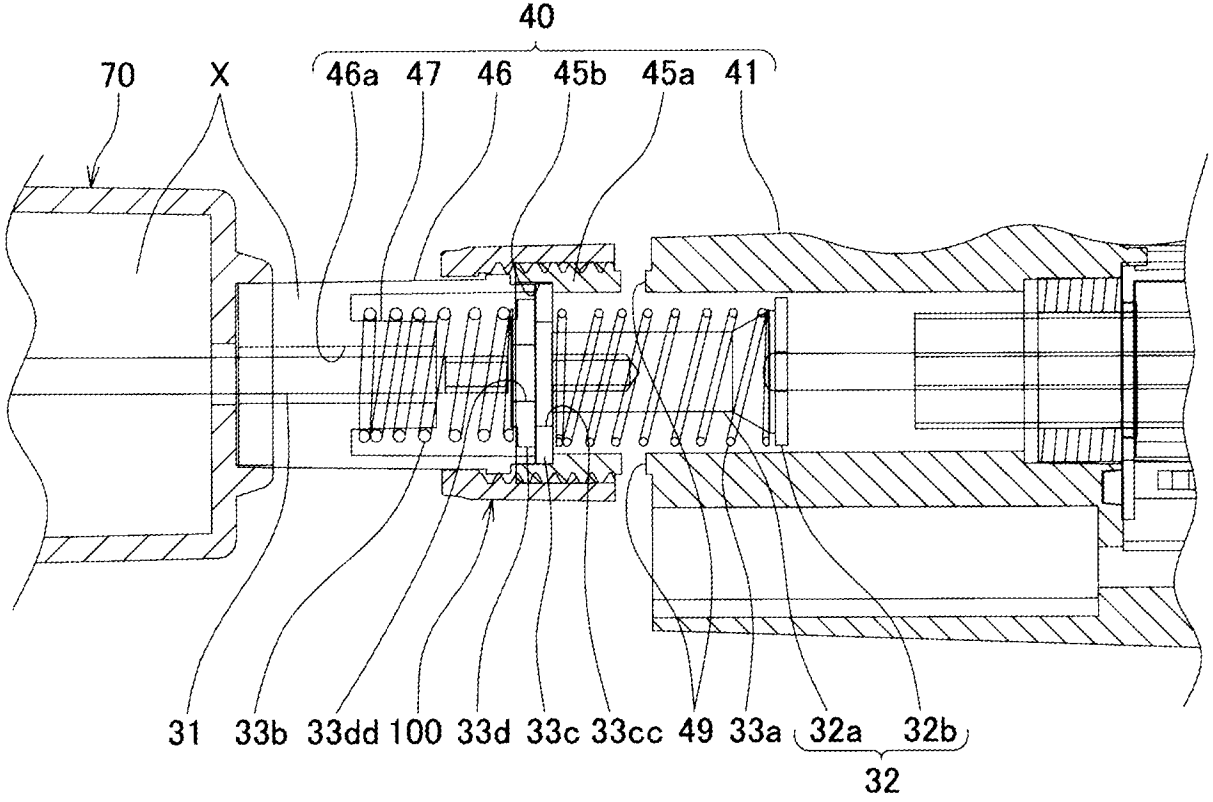
FIG. 5 is a longitudinal section enlarged view of the case portion of the pipette device.

A step portion 45*b* is provided on an inner side of the other end portion 45*a* of the first case portion 41, which has a hollow tubular shape, and is disposed to be engaged with the first washer portion 33*c* in a case of being connected to the second case portion 46 via a connecting portion 100. Therefore, an outer diameter of the first washer portion 33*c* is almost the same dimension as an inner diameter of the step portion 45*b* such that the first washer portion can be disposed in the inner diameter (refer to FIG. 5).

The second case portion 46 has a hollow tubular shape, and the piston rod portion 30 is disposed to be movable in the front end portion direction F or the rear end portion direction R in a tube hole 46*a* that is disposed in a center of the tubular shape. In addition, the other end of the second spring portion 33*b* is disposed in the recessed portion 47 as described above.

In addition, although the air hole 49 can be included in any one of or both of the first case portion 41 and the second case portion 46, the air hole is provided in the other end portion 45*a* of the first case portion 41 in the embodiment. The air hole functions as a discharge outlet through which the air X containing a chemical solution is discharged or an introduction inlet through which fresh air is introduced.

Figure 6:
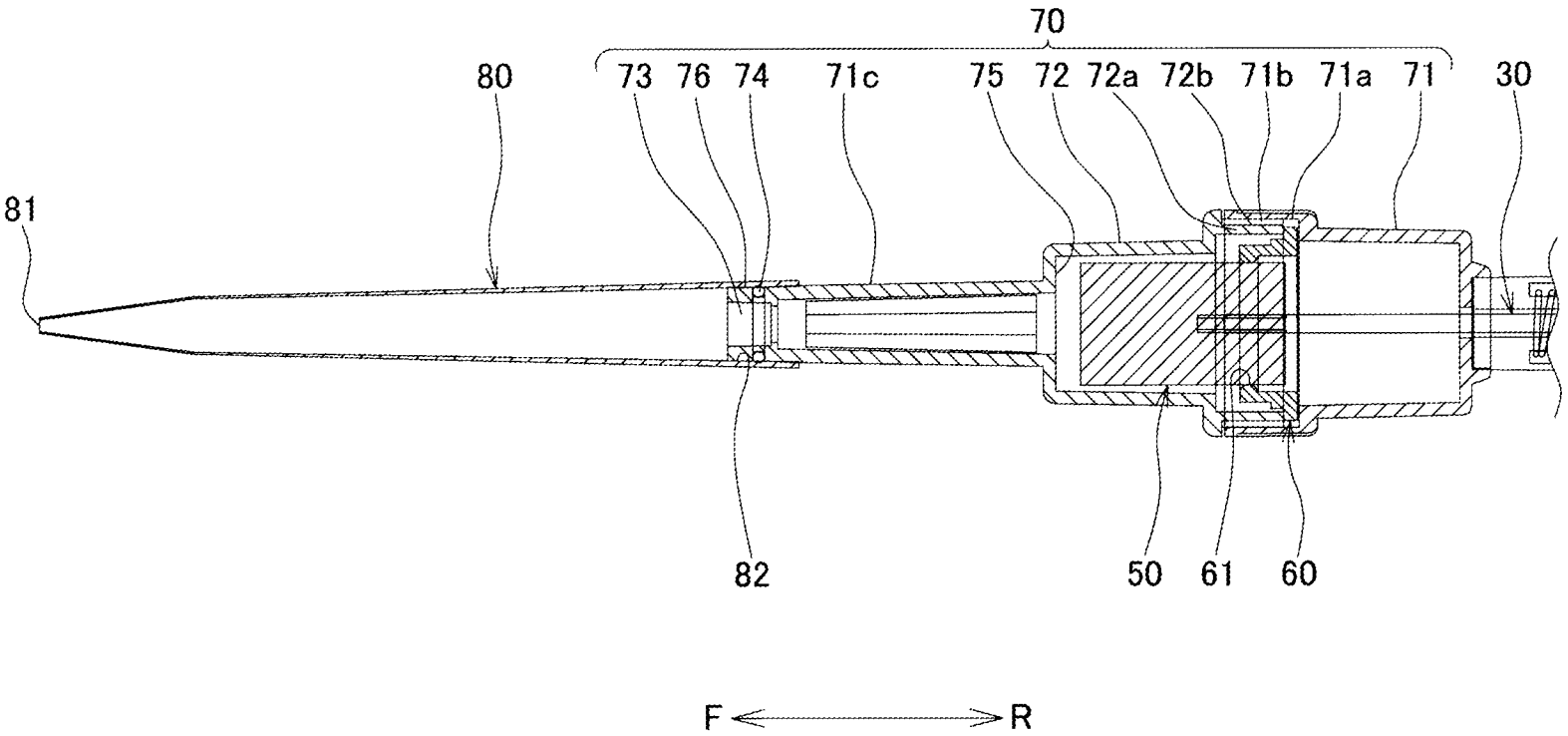
FIG. 6 is a longitudinal section enlarged view of a piston accommodating portion of the pipette device.

The piston accommodating portion 70 functions as a so-called piston cylinder, and has a piston accommodating upper portion 71 and a piston accommodating lower portion 72, both of which have bottomed tubular shapes. Since the piston accommodating upper portion and the piston accommodating lower portion respectively have a female thread portion 71*b* and a male thread portion 72*b* in opening portions 71*a* and 72*a*, the piston accommodating upper portion and the piston accommodating lower portion are screwed with and fixed to each other. That is, the male thread portion 72*b* is screwed with the female thread portion 71*b* (refer to FIG. 6).

In addition, the packing portion 60 is disposed between the piston accommodating upper portion 71 and the piston accommodating lower portion 72, and is fixed such that the packing portion 60 is sandwiched between the piston accommodating upper portion 71 and the piston accommodating lower portion 72. The packing portion 60 has an annular shape, and has a hole-shaped annular inner portion 61. The piston portion 50 is disposed to be slidable in the annular inner portion 61. It is preferable to make the packing portion 60 of rubber or a synthetic resin which has flexibility. In addition, the packing portion 60 is configured to secure watertightness between the piston portion 50 and the packing portion such that the air X containing components of a sucked liquid is unlikely to infiltrate into the case portion 40. For this reason, for example, the infiltration of the air X can be further blocked by applying grease to the piston portion 50 and the annular inner portion 61 of the packing portion 60. In a case of long-term use, the invention is not limited thereto as described above.

The piston accommodating portion 70 has a hollow tubular pipette tip holding portion 71*c* which is long in the front end portion direction F, and the pipette tip 80 can be connected to the pipette tip holding portion 71*c*. The pipette tip holding portion 71*c* has a tapered shape that is gradually narrowed toward a tip portion direction F in plan view, and a filter 73 is fitted into a tip portion 76. In addition, the pipette tip holding portion has a slip stopper 74 made of rubber on an outer periphery of the tip portion 76, and the slip stopper makes connection to the pipette tip 80 reliable.

The pipette tip 80 has a shape in which a tip portion 81 is thin and pointed, and is configured to easily suck a small amount of a liquid. In addition, the pipette tip has a tapered shape that gradually becomes thicker toward the rear end direction R when seen from the side, and has a hollow tubular shape. A rear end portion 82 is open, and the slip stopper 74 disposed on the outer periphery of the tip portion 76 of the pipette tip holding portion 71*c* is fitted to the rear end portion as described above. It is preferable to make the pipette tip 80 removable and of a transparent synthetic resin, and accordingly, the pipette tip can be replaced for each chemical solution to be used (refer to FIG. 6).

Figure 7:
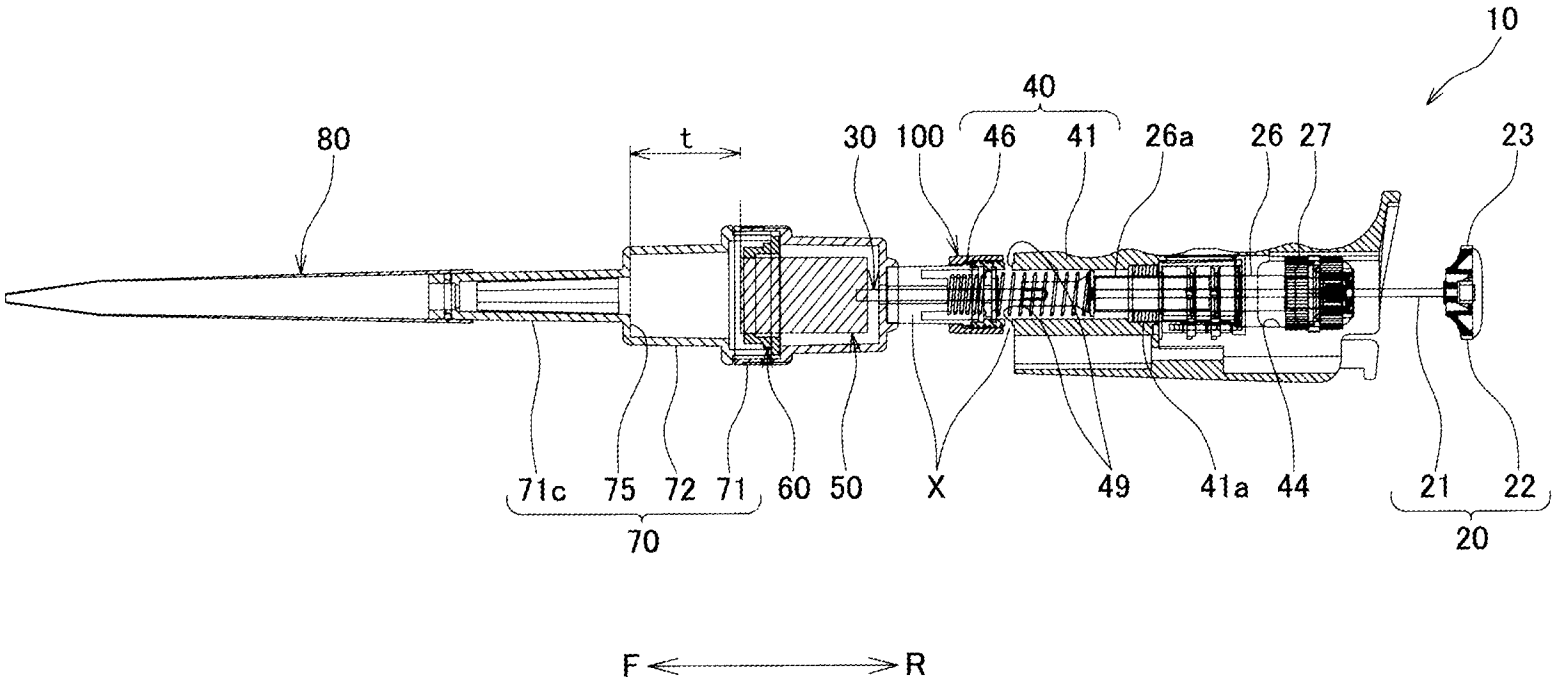
FIG. 7 is a longitudinal sectional view of a knob portion disposed to the right in the pipette device.

The pipette device 10 having such a configuration can adjust an amount of a liquid to be sucked. Herein, in a case where the knob portion 22 of the pressing portion 20 is positioned on the rightmost side in the drawings, that is, in the rear end portion direction R, a position of the piston portion 50 from a bottom portion 75 of the piston accommodating portion 70 is set as an original position t (refer to FIG. 7).

When a user presses the pressing portion 20 in this state, the piston portion 50 approaches the bottom portion 75 of the piston accommodating portion 70. This position is referred to as a first approach position t1 (refer to FIG. 2). The movement amount of the piston portion 50 in the piston accommodating portion 70, which is from the original position t (refer to FIG. 7) to the first approach position t1, is the amount of a liquid to be sucked. Herein, although the first approach position t1 does not change except for a case to be described later even in a case where an amount to be sucked is adjusted, the original position t of the piston portion 50 from the bottom portion 75 of the piston accommodating portion 70 in a case of a state where the pressing portion 20 is not pressed changes to approach the bottom portion 75. At the original position t which corresponds to a case where the pressing portion 20 is positioned to the farthest extent in the rear end portion direction R, a value of the graduation portion 43 is 6,000 (refer to FIGS. 2 and 4*c*). The graduation portion indicates 6,000 microliters at the maximum. It is preferable that a range of use in the embodiment be a range of 1,000 to 5,000 microliters. In addition, although it is preferable that the value of the graduation portion 43 be a capacity in a range of 0.2 to 2 microliters, a range of 1 to 10 microliters, a range of 2 to 20 microliters, a range of 10 to 100 microliters, a range of 20 to 200 microliters, a range of 200 to 1,000 microliters, or a range of 2,000 to 10,000 microliters, it is evident that the value is not limited to the capacities, depending on market requirements and a type of a chemical solution to be used.

As described above, when the knob portion 23 or the second knob portion 27 rotates, the tubular portion 26 rotates. Since the female thread portion 41*a* is formed inside the first case portion 41 of the case portion 40 to be described later and the male thread portion 26*a* is formed also in the tubular portion 26, the tubular portion 26 is screwed with the case portion. When the shaft portion 21 is rotated about the axis, also the tubular portion 26 rotates, and the tubular portion 26 moves in the tip portion direction F of the shaft portion 21 with respect to the shaft portion 21. Accordingly, by moving the thick shaft upper end portion 32 of the piston rod portion 30 in the tip portion direction F, the piston portion 50 is also pressed and moves in the tip portion direction F. At this time, a graduation gradually decreases from 6,000 to 0.

At this time, since the second spring portion 33*b* has a spring constant higher than the first spring portion 33*a* as described above, the first spring portion 33*a* is gradually compressed first. Simultaneously, the piston portion 50 also moves to approach the bottom portion 75 of the piston accommodating portion 70.

Figure 8:
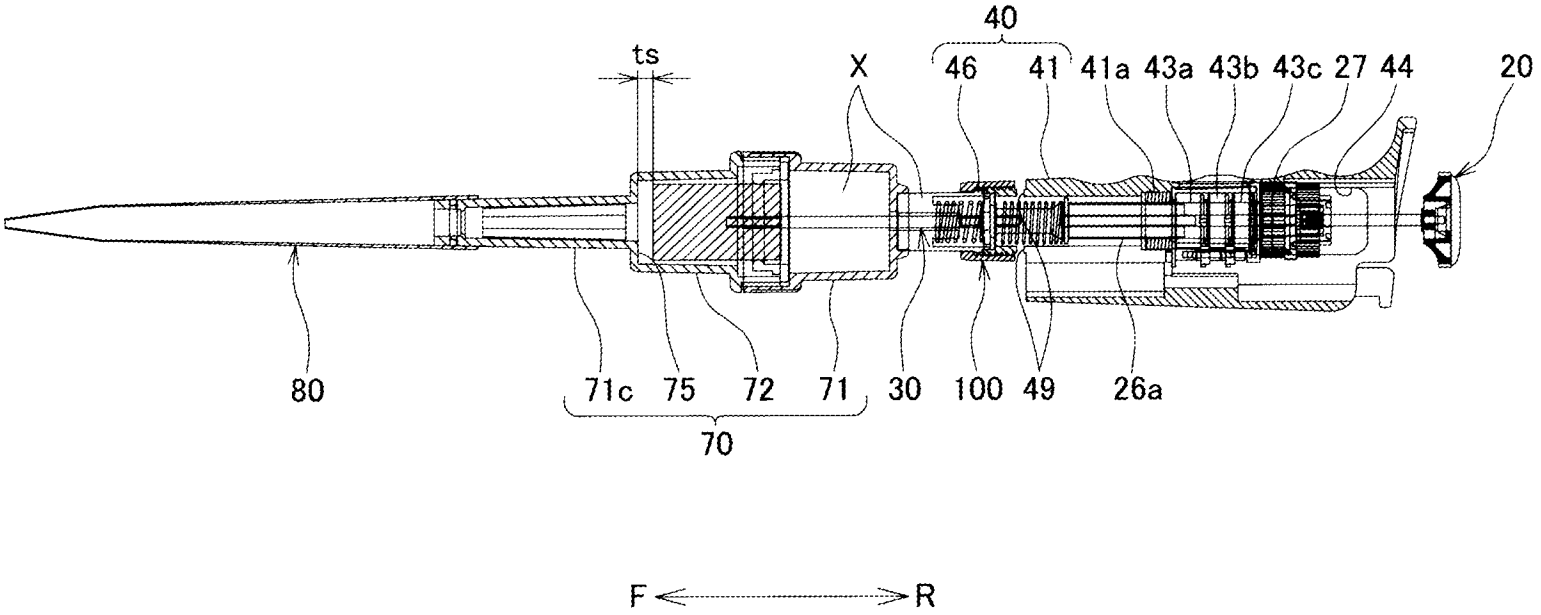
FIG. 8 is a longitudinal sectional view of the knob portion disposed to the left in the pipette device.

When the knob portion 23 or the second knob portion 27 rotates, the first spring portion 33*a* is gradually compressed. When the piston portion moves to approach the bottom portion 75 of the piston accommodating portion 70, the thick shaft portion 32*a* passes through the center hole portion 33*cc* of the first washer portion 33*c* and comes into contact with the second washer portion 33*d* while the thick shaft upper end portion 32 compresses the first spring portion 33*a*. This position is a point where a graduation is "0", and is a position where an adjusted position ts of the piston portion 50 (refer to FIG. 8) becomes the same position as the first approach position t1 (refer to FIG. 1).

To describe in further detail, a suction amount is defined by the compression of the extended first spring portion 33*a*.

Therefore, a position where the first spring portion 33*a* is compressed at the maximum, that is, a position where the thick shaft portion 32*a* passes through the center hole portion 33*cc* of the first washer portion 33*c* and comes into contact with the second washer portion 33*d* is a position to become the adjusted position ts of the piston portion 50. Also the adjusted position ts of the piston portion 50 is the same position as the first approach position t1 where the piston portion approaches the bottom portion 75 of the piston accommodating portion 70. Therefore, when the graduation becomes 0, the adjusted position ts separated away from the bottom portion 75 of the piston accommodating portion 70 in a state where the pressing portion 20 is not pressed becomes the point where the graduation is "0" (refer to FIGS. 4*a* and 8), and the adjusted position ts of the piston portion 50 becomes the same position as the first approach position t1 as described above. Thus, an amount of a liquid that can be sucked by the pipette device 10 becomes 0 since the first spring portion 33*a* cannot be compressed any further.

In addition, when the knob portion 23 or the second knob portion 27 rotates reversely, the piston portion 50 moves in the rear end portion direction R. Accordingly, the position of the piston portion 50 changes to a position separated away from the bottom portion 75 of the piston accommodating portion 70.

Therefore, when the piston portion 50 is at a position where a distance from the bottom portion 75 of the piston accommodating portion 70 is short, this position is the position of the piston portion 50 in a case of a state where the pressing portion 20 is not pressed. Thus, the movement amount of the piston portion 50 from the piston portion 50 in a case of a state where the pressing portion 20 is pressed to a position to the bottom portion 75 of the piston accommodating portion 70, that is, to the first approach position t1 becomes an amount of a liquid to be sucked by the pipette device 10. Consequently, when a distance between the piston portion 50 and the bottom portion 75 of the piston accommodating portion 70 is short, an amount to be sucked is small. When a distance between the piston portion 50 and the bottom portion 75 of the piston accommodating portion 70 is long, an amount to be sucked is large. The movement amount is made clear by the lower stage 43*a*, the middle stage 43*b*, and the upper stage 43*c* which are included in the graduation portion 43 displaying a three-digit number. The piston portion 50 can be disposed at any position between the original position t and the adjusted position ts, and this range can be freely adjusted. In addition, an accurate suction amount can be measured by the graduation portion 43.

In a case of performing work of the pipette device 10 sucking a liquid, a user presses the pressing portion 20, and then the piston portion 50 is moved from a position to the bottom portion 75 of the piston accommodating portion 70, that is, any original position t to the first approach position t1 after adjusting a suction amount as described above. After then, the user takes the hand off the pressing portion 20, and a liquid chemical is sucked as the pressing portion 20 is restored in the rear end portion direction R by the elastic portion 33. The piston portion 50, the packing portion 60, the piston accommodating portion 70, the pipette tip holding portion 71*c*, and the pipette tip 80 are made of a synthetic resin, and thus there is no possibility of corrosion thereof in a case where this acidic or alkaline liquid is sucked. However, since the pressing portion 20 or the piston rod portion 30 is configured of stainless steel, there is a possibility of corrosion under certain conditions. While watertightness between the piston portion 50 and the packing portion 60 is maintained in a short period of time, the air X having a possibility of corrosion gradually leaks from a gap between the piston portion 50 and the packing portion 60 in long-term use, and infiltrates into the piston accommodating upper portion 71 of the piston accommodating portion 70 or the case portion 40 in some cases.

Thus, by discharging the infiltrated acidic or alkaline air X from the air hole 49, corrosion of the piston accommodating upper portion or the case portion can be prevented. This can be performed by the following operation. That is, when a user presses the pressing portion 20 of the pipette device 10, the piston portion 50 moves toward the bottom portion 75 of the piston accommodating portion 70 through the piston rod portion 30 (refer to FIG. 2), and moves to the first approach position t1 where the piston portion approaches the bottom portion 75 as described above. In this state, a liquid (not illustrated) infiltrates into a pipette tip 80, and the user takes the hand off the pressing portion 20. Accordingly, the elastic portion 33 returns the pressing portion 20 in the rear end portion direction R. Consequently, when the piston portion 50 moves in a direction of separating away from the bottom portion 75 of the piston accommodating portion 70, that is, the rear end portion direction R, the liquid is simultaneously sucked from the pipette tip 80 (refer to FIG. 7). When the user presses the pressing portion 20 of the pipette device 10 again, the piston portion 50 moves toward the bottom portion 75 of the piston accommodating portion 70 through the piston rod portion 30, and the piston portion 50 is disposed at the first approach position t1 where the piston portion approaches the bottom portion 75. Thus, the sucked liquid can be discharged. The sucked liquid cannot be completely discharged in some cases depending on the viscosity of the liquid. At this time, the user further presses the pressing portion 20 of the pipette device 10. Accordingly, the second washer portion 33*d* is further pressed from the position where the first spring portion 33*a* is compressed at the maximum, that is, the position where the thick shaft portion 32*a* passes through the center hole portion 33*cc* of the first washer portion 33*c* and comes into contact with the second washer portion 33*d*. Accordingly, the second spring portion 33*b* having a spring constant higher than the first spring portion 33*a* is further compressed, and the piston portion 50 comes into contact with the bottom portion 75 of the piston accommodating portion 70. Accordingly, the sucked liquid can be completely discharged from the piston accommodating portion 70 (not illustrated), and the pipette device 10 can suck and discharge an accurate amount of the liquid.

However, in some cases, the air X containing components of the liquid enters the case portion 40 via the piston accommodating upper portion 71 of the piston accommodating portion 70 from between the piston portion 50 and the packing portion 60 in long-term use. Accordingly, metal parts disposed in the piston accommodating portion 70 and the case portion 40 have a possibility of corrosion.

In order to prevent the corrosion, the case portion 40 has the air hole 49. That is, as the piston portion 50 moves from the first approach position t1 in the rear end portion direction R, the air X staying in a case 40 is discharged from the air hole 49 (refer to FIG. 7).

Figure 2:
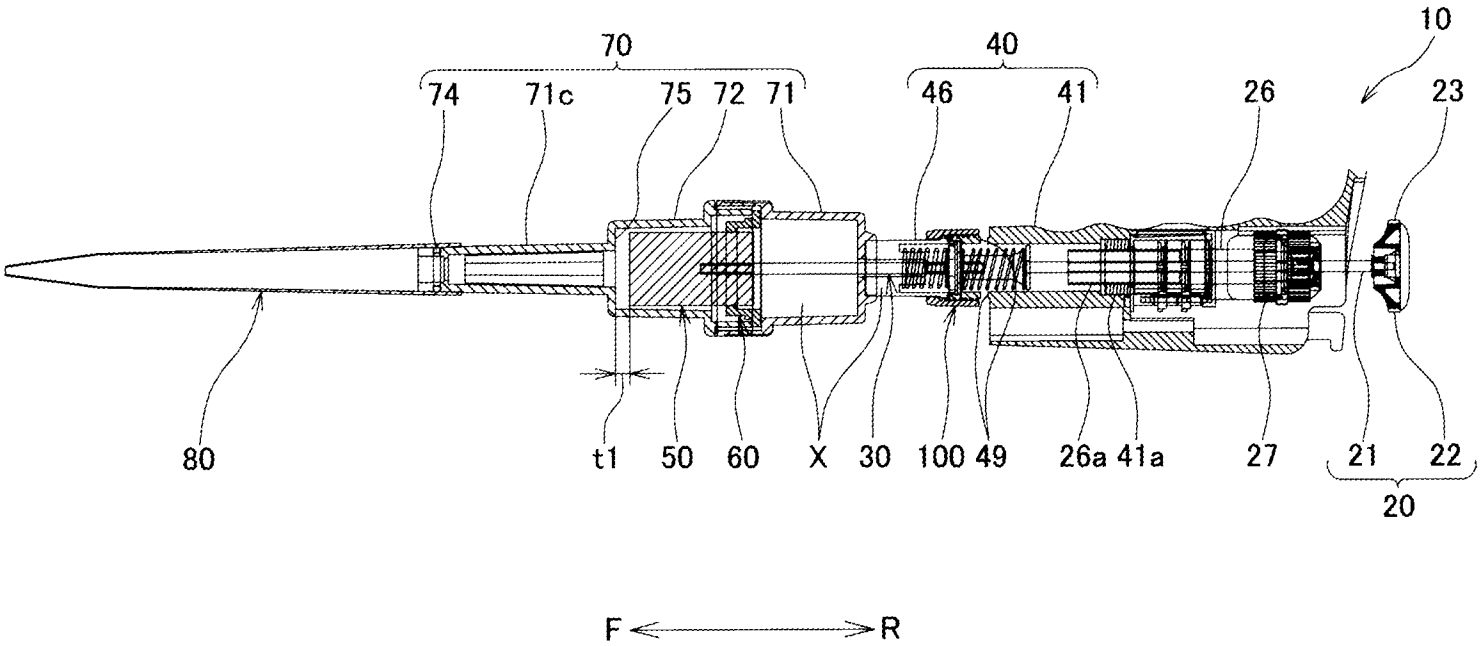
FIG. 2 is a longitudinal sectional view of the pipette device.

As the piston portion 50 is again pressed in the tip portion direction F after then, this time, external air is newly introduced into the case portion 40 or the piston accommodating portion 70 from the air hole 49 (refer to FIG. 2). The air X is discharged from the air hole 49, or fresh air is introduced in response to motion of the piston portion 50 moving in the front end portion direction F and the rear end portion direction R as described above. Therefore, although the piston rod portion 30 disposed inside the piston accommodating portion 70 and the case portion 40, the long shaft portion 21 of the pressing portion 20, and the first spring portion 33*a*, the second washer portion 33*d*, and the second spring portion 33*b* of the elastic portion 33 can be configured of a metal, a possibility that the metal parts are exposed to the acidic or alkaline air X generated from the sucked liquid for a long period of time is low. Although the air X is discharged from the air hole 49 in response to motion of the piston portion 50 moving in the front end portion direction F and the rear end portion direction R, the air X is not necessarily prevented from flowing out from the air hole 49 even in a case where the piston portion 50 is stopped.

In addition, such operation is repeated each time the piston portion 50 moves. Therefore, the corrosion of the metal parts can be prevented in normal use of the pipette device 10. Since corrosion can be prevented by newly providing the air hole 49 as described above, making a change in a material of a metal part or performing surface treatment such as plating is not necessary, and thus corrosion can be prevented without incurring additional costs.

Figure 9:
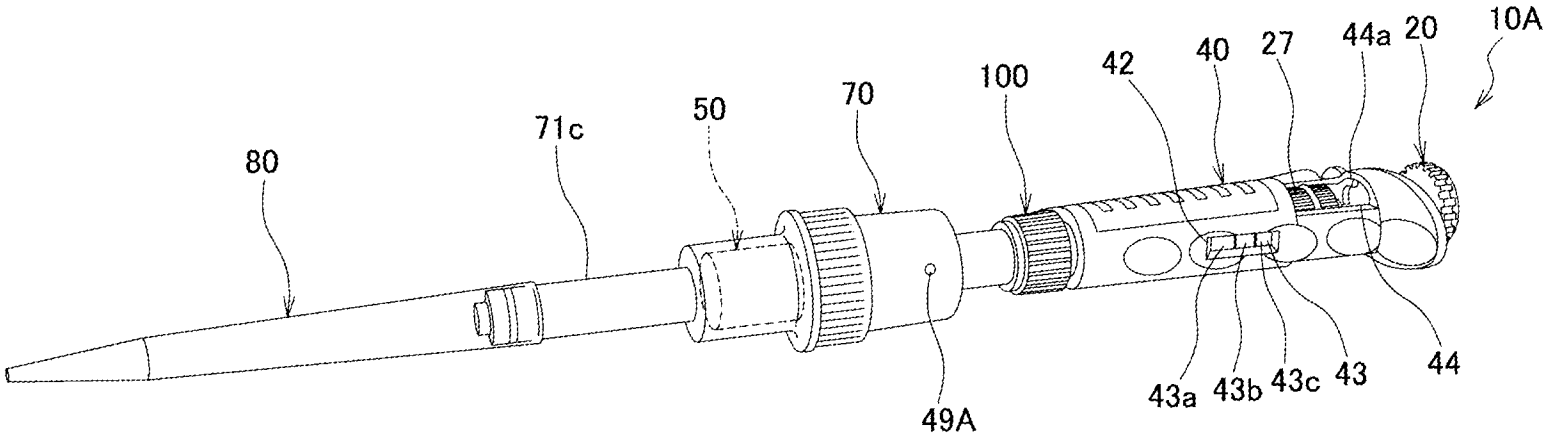
FIG. 9 is a perspective view of a pipette device of another embodiment.
Figure 10:
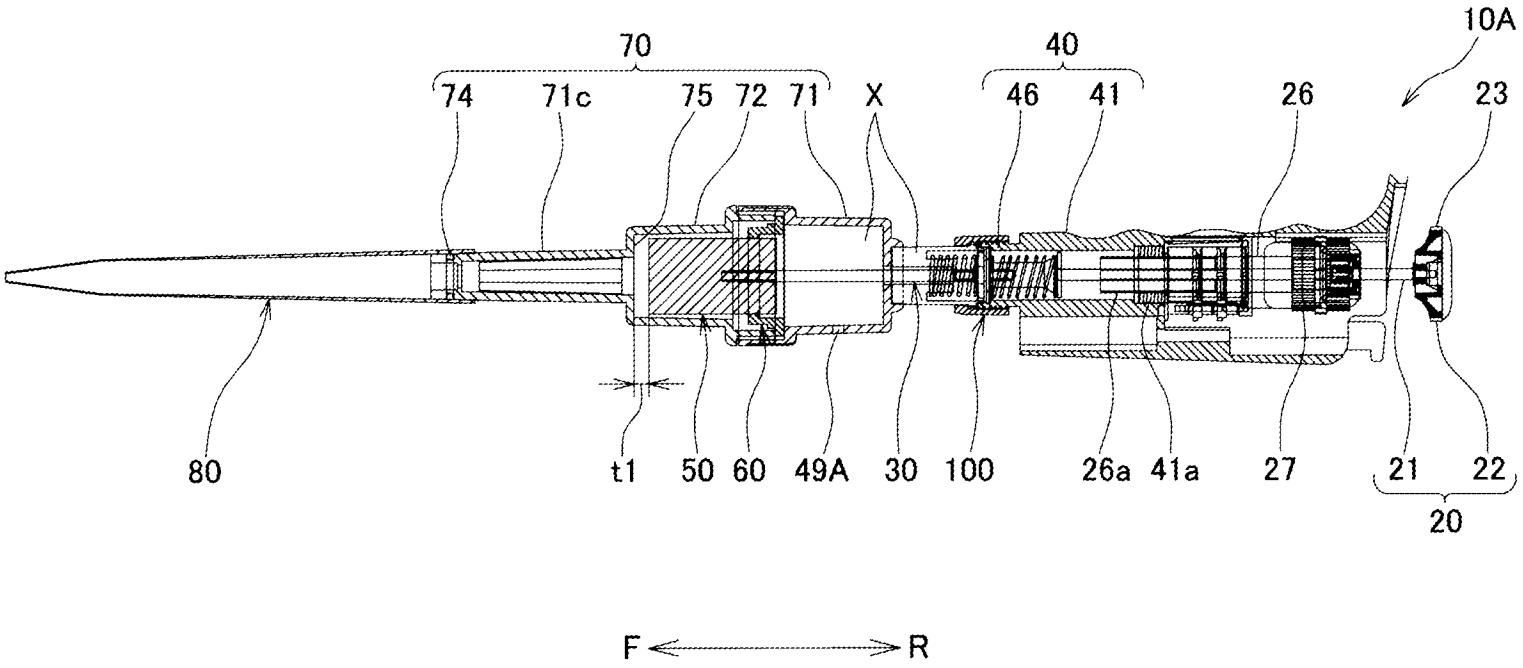
FIG. 10 is a longitudinal sectional view of the pipette device of another embodiment.

In another embodiment, it is preferable to dispose a second air hole 49*a* in the piston accommodating upper portion 71 of the piston accommodating portion 70 in another pipette device 10A (refer to FIGS. 9 and 10). Specifically, since the air X containing components of a liquid enters the piston accommodating upper portion 71 from between the piston portion 50 and the packing portion 60, the corrosion of metal parts disposed in the piston accommodating portion 70 and the case portion 40 can be prevented by providing the second air hole 49*a* in the piston accommodating upper portion 71. A method of discharging the air X, in this case, is the same as described above. Therefore, although the air X is discharged from the air hole 49*a* in response to motion of the piston portion 50 moving in the front end portion direction F and the rear end portion direction R, the air X is not necessarily prevented from flowing out from the air hole 49*a* even in a case where the piston portion 50 is stopped.

It is preferable to provide the air hole closer in the rear end portion direction R than the piston accommodating upper portion 71 of the piston accommodating portion 70 is. Another pipette device 10A has the same configurations as the pipette device 10 of the first embodiment except for the position of the air hole 49*a*. It is preferable to dispose the air hole to be positioned closer in the rear end portion direction R than the position of the packing portion 60 is. In such a manner, it is also possible to additionally dispose the second air hole 49*a* while disposing the air hole 49. Therefore, a plurality of air holes 49 and a plurality of second air holes 49*a* can also be disposed although not illustrated. In addition, the plurality of air hole 49 or the plurality of second air hole 49*a* can also be disposed.

The invention claimed is:

1. A pipette device, comprising:

a pressing portion that is disposed on a rear end portion for a user to press;

a piston rod portion that is connected to the pressing portion;

a piston portion that is connected to the piston rod portion and is movable in order to suck a liquid;

a case portion in which the piston rod portion is disposed and which has an air hole for discharging an air generated from the liquid sucked by the piston portion to an outside; and a piston accommodating portion configured for movably disposing the piston portion and including:

a piston accommodating upper portion that has a female thread portion;

a piston accommodating lower portion that has a male thread portion, wherein the piston accommodating upper portion and the piston accommodating lower portion are screwed with and fixed to each other by screwing the female thread portion with the male thread portion; and a packing portion that has an annular shape between the piston accommodating upper portion and the piston accommodating lower portion and has an annular inner portion, wherein the piston portion is disposed to be slidable in the annular inner portion of the packing portion that has the annular shape, and the air is discharged from the air hole of the case portion in response to movement of the piston portion;

wherein the case portion comprises a first case portion and a second case portion engaged with each other, and the air hole is included in any one of or both of the first case portion and a second case portion;

wherein a center of each of the pressing portion, the piston rod portion, the case portion, the packing portion, the piston accommodating portion, and the piston portion is disposed on the same line;

along the same line, the piston accommodating lower portion, the piston accommodating upper portion, the second case portion, the first case portion are disposed in this order; and the air hole is configured to directly communicate an inside of the case portion and the outside.

2. The pipette device according to claim 1, further comprising:

an elastic portion that biases the piston rod portion in a rear end portion direction.

3. The pipette device according to claim 1, further comprising:

a pipette tip holding portion that is disposed in a front end portion direction of the piston accommodating portion and removably holds a pipette tip.

4. The pipette device according to claim 3, further comprising:

an elastic portion that biases the piston rod portion in a rear end portion direction.

* * * * *